US005370389A

United States Patent [19]

Reising

[11] Patent Number: 5,370,389

[45] Date of Patent: Dec. 6, 1994

[54] GOLF RANGE METHOD AND APPARATUS

[76] Inventor: Douglas J. Reising, 8455 Village Dr., Florence, Ky. 41042

[21] Appl. No.: 203,495

[22] Filed: Feb. 28, 1994

Related U.S. Application Data

[63] Continuation of Ser. No. 951,869, Sep. 25, 1992, abandoned.

[51] Int. Cl.[5] ..... A63B 69/36

[52] U.S. Cl. ..... 273/35 B; 273/213; 273/182 A

[58] Field of Search ..... 273/176, 181, 182, 32 R, 273/184 R, 35 R, 35 B, 213, 62, 233

[56] References Cited

U.S. PATENT DOCUMENTS

| | | | |
|---|---|---|---|
| 2,936,179 | 5/1960 | Thurston | 273/182 R |
| 3,599,981 | 8/1971 | Zausmer | 273/176 A |
| 3,708,173 | 1/1973 | Hewson, Jr. | 273/182 R |
| 3,719,362 | 3/1973 | Blambard | 273/182 R |
| 4,141,557 | 2/1979 | Ingufersen | 273/181 F |
| 4,171,812 | 10/1979 | Marsin | 273/182 R |
| 4,272,078 | 6/1981 | Vinette | 273/182 R |
| 4,336,939 | 6/1982 | Krumlauf | 273/182 R |
| 4,846,478 | 7/1989 | Saint-Cricq | 273/182 A |
| 5,033,245 | 7/1991 | Sullivan et al. | 273/184 R |
| 5,163,677 | 11/1992 | Foley | 273/181 R |

FOREIGN PATENT DOCUMENTS

| | | | |
|---|---|---|---|
| 356522 | 9/1931 | United Kingdom | 273/182 A |

OTHER PUBLICATIONS

"Golf's Most Unique New Target Green . . . ", *Golf Range & Recreation Report,* Jun/Jul., 1992.

"Range Target is Revolutionary", *Turf & Recreation Magazine,* (date unknown).

"Having some fun times on the practice range", *Golf Product News,* Jan./Feb. 1992.

"Taking target practice on range", *Daily News,* (city unknown) (date unknown).

*Hole In One–Pro Shot,* Product Literature (date unknown).

*Primary Examiner*—Mark S. Graham

[57] ABSTRACT

A golfing range game is disclosed which allows a player to practice both long-range and close-range shots while aiming for different target greens located at varying distances from the teeing area. If the player lands a ball on one of the greens, he receives a score on a visual display that is located near the teeing area so the player can easily see his score. Each of the greens is sloped so that a ball that lands upon the greens' surface will roll into a hole located at the lowest point of the surface. Each ball has a distinctive marking, either a color code or a bar code, so that it can be determined from which tee the ball was hit. After the ball rolls into the hole of a green, a sensor scans the ball and identifies from which tee the ball came. A score is then added to the visual display at the corresponding tee. Each green can have a different point value, depending upon the difficulty of the golf shot required to land on that green.

14 Claims, 8 Drawing Sheets

GOLF RANGE METHOD AND APPARATUS

This is a continuation of application Ser. No. 07/951,869, filed Sep. 25, 1992, abandoned.

TECHNICAL FIELD

The present invention relates generally to golfing ranges, and is particularly directed to a golfing range of the type which has several target greens at which a player aims to score points. The invention will be specifically disclosed in connection with such a range in which the target greens are sloped so that a golf ball landing on each green will roll into a hole containing a sensor that can identify from which tee the ball was hit.

BACKGROUND OF THE INVENTION

Many different types of golf games are available to the public today, including standard golf courses, driving ranges, miniature golf-type putting courses, and even computerized indoor golfing games. Most of these golf games, however, do not enable a person to use all of his skills by using the entire range of golf clubs. Although many driving ranges have target greens that a person can aim at, the greens are not necessarily positioned such that the person can see how successful he has been in causing his ball to land on one of those greens.

One golf game available at the present time provides a target and is disclosed in U.S. Pat. No. 4,336,939. According to this patent a golf chipping and putting game is constructed of a number of pockets which are used as targets by the player. This is a variation of miniature golf in that high-angle irons can be used to try to place the ball in one of the target pockets. In this game, however, it is not intended that a golfer can practice the use of long irons or woods for hitting target greens at a realistic distance.

Another golfing game that is presently available is disclosed in U.S. Pat. No. 3,708,173, in which a golfer attempts to hit a ball into one of several holes on a nearby green. As a ball is hit into the hole, the player receives a score on a scoreboard associated with each green. In this game, however, the greens are so close to a player that the player again cannot practice his long irons or woods in an attempt to hit a green at a realistic distance.

Existing driving ranges often have small greens that include target flags at which to aim. At such driving ranges, the greens are typically located at varying distances from the driving tees, from as little as one hundred years to more than 250 yards. Colored balls may occasionally be used when such a driving range is conducting some type of promotion, such as a hole-in-one contest. The present driving ranges do not, however, include any type of automatic scoring capabilities. Even the hole-in-one contest using colored balls requires a person to eventually inspect the hole to see if any ball found its way into the hole; the colored ball is not automatically sensed.

The presently available golfing games that give a player an automatic score as that player achieves success in hitting a target are all designed for either putting or very short distance chip shots. In addition, in some of the games available at the present time, the targets are so small and at such a distance that it would be very difficult to obtain any score whatsoever. Finally, each of the games available at the present time requires construction of a special facility and could not be easily retrofitted into an existing driving range. None of the prior art games are intended for use as a driving range to practice driving skills at realistic distances.

SUMMARY OF THE INVENTION

Accordingly, it is a primary object of the present invention to provide a golfing game which can be retrofitted into an existing driving range in which the golfer attempts to place his ball upon one of several target greens. If successful, a score is indexed at a display near the golfer's location.

It is another object of the present invention to provide a driving range game in which the player can practice his golfing skills at realistic distances and optionally have his score indicated on a display.

It is a further object of the present invention to provide a driving range game in which several players can simultaneously play the game, each accumulating an individual score which can be compared to the scores of each of the other players, thereby allowing a competition to take place.

Additional objects, advantages and other novel features of the invention will be set forth in part in the description that follows and in part will become apparent to those skilled in the art upon examination of the following, or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved driving range game is provided that allows a player to practice his skill in placing golf balls upon target greens at varying realistic distances from his tee. Each of the target greens has a concave, sloped surface which causes the ball to roll downward into a receptacle hole, where the ball can be electronically sensed and counted by a scoring device. Each tee of the driving range would have golf balls having either different color schemes or bar codes upon their surfaces, such that the sensing instruments can determine from which tee the golf ball was driven, thereby enabling the scoring device to properly record the score at a display near the golfer. In this manner, each golfer using this driving range accumulates an individual score, which can be compared to the scores of other players who are simultaneously using the same driving range game.

Each target green contains a graded rear portion which allows the player to see his ball hitting the green before the ball rolls down into the receptacle hole, which is located at the lowest point of each green. Once the ball falls through the receptacle hole, it is held in place by indexer pins until previously arriving balls have been processed by the sensing devices. Once the ball arrives at the sensing device, the ball is identified by either a bar code reader or a color identifying device. At that time a signal is sent to a display at a corresponding tee area and the golfer's score is indexed to indicate that the golfer has successfully hit that target green. After this takes place, the ball is then sent through an ejecting device which forces the ball into a storage container, where it waits until employees of the driving range can retrieve it for later use.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawing and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
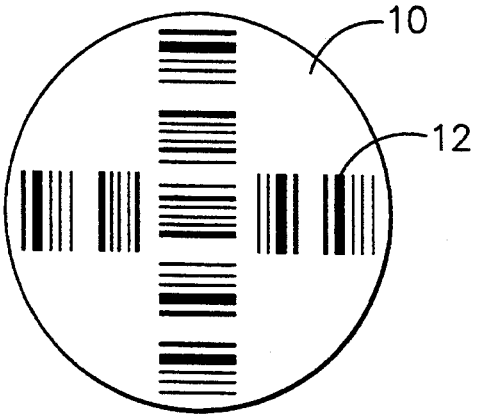
FIG. 1 is a plan view of a golf ball having a bar code stamped upon its surface.

In order to play the game of the present invention, it is necessary that the golf balls be marked in some way so that they can be automatically identified as having come from a particular teeing area. FIG. 1 shows a standard golf ball 10 on which a bar code 12 has been hot stamped or marked by some other method. Alternatively, a variety of colors could be used to color code the balls. A group of such golf balls 10 having the same color, or having the same bar code is required for use at each of the teeing areas 20. Exemplary sensing means could be bar code sensors or color sensors to properly identify the teeing area from which each ball came.

Figure 2:
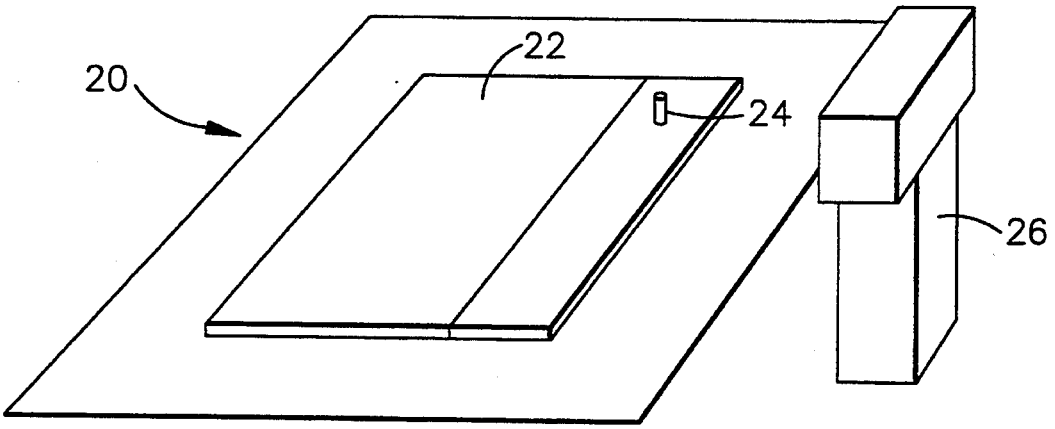
FIG. 2 is a perspective view of a golf teeing area for a driving range, including a scoring device.

A typical teeing area 20 is depicted in FIG. 2, which includes a teeing mat 22, a driving tee 24, and a scoring display 26. The player is directed to the correct teeing area 20 which corresponds to the color or bar code on the golf balls 10 that have been provided to that player. The player tees his ball on either the driving tee 24, or elsewhere on the teeing mat 22. It will be understood that each teeing area 20 may merely comprise a designated area of grass, rather than a rubber or plastic teeing mat 22.

Figure 3:
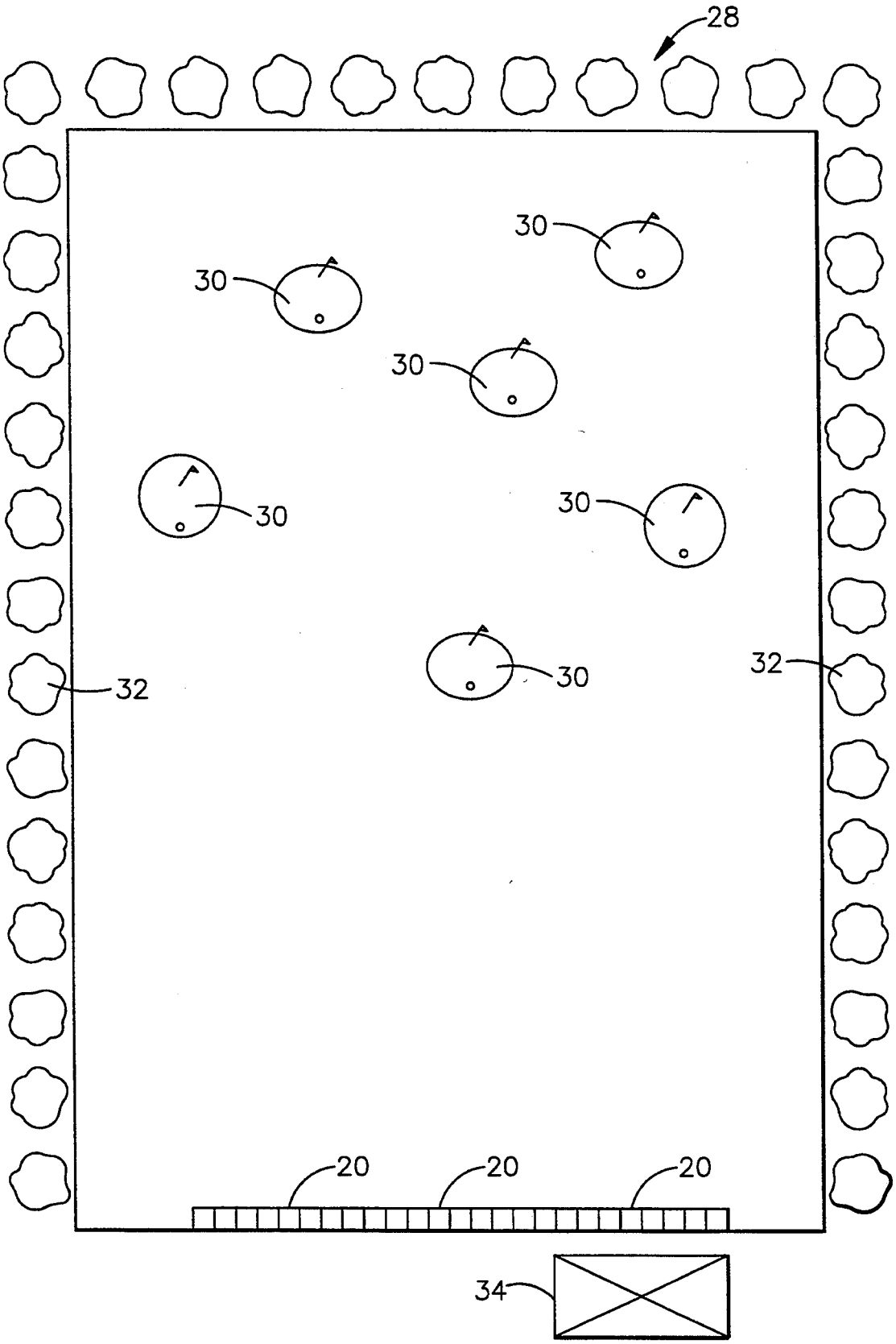
FIG. 3 is a plan view of an entire driving range constructed in accordance with the principles of the present invention.

A driving range 28 constructed in accordance with the principles of the present invention is depicted in FIG. 3. The perimeter of the driving range 28 can be bordered by trees 32, if desired. A number of target greens 30 are positioned at various locations and ranges from the teeing areas 20. A typical driving range would include a clubhouse 34 where the golfer stops to buy his balls before playing the game. As related above, each of the balls 10 would contain some form of identification such as a distinct color or a distinct bar code 12, which is indicative of from which of the teeing areas that a ball 10 has been driven. If a player wishes to practice the driving range without playing the game, then that person can be issued standard white golf balls, having none of the colors or bar codes used by the scoring devices of the present invention 28.

Figure 4A:
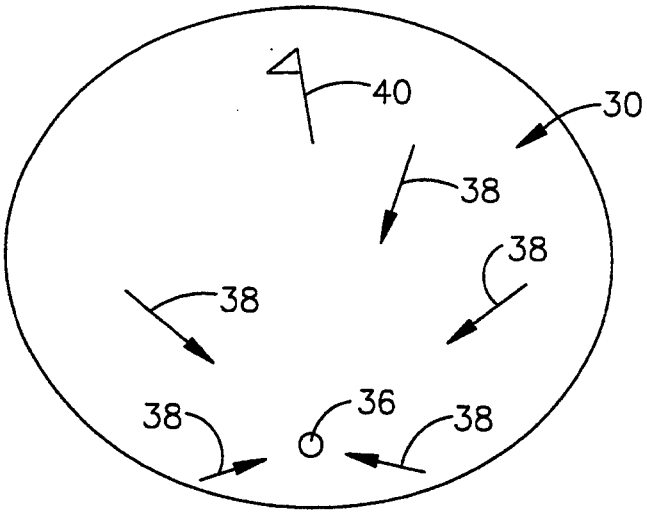
FIG. 4A is a plan view of one of the target greens of the driving range of FIG. 3.

As can be seen in FIG. 4A, each of the target greens 30 includes a target flag 40 and a receptacle hole 36, which is located near the front portion of the green (nearest to teeing areas 20). Target green 30 is sloped downhill, having the general shape of a concave surface, so that the receptacle hole 36 is at the lowest portion of target green 30. The arrows 38 indicate the direction of slope at various portions of target green 30.

Figure 4B:
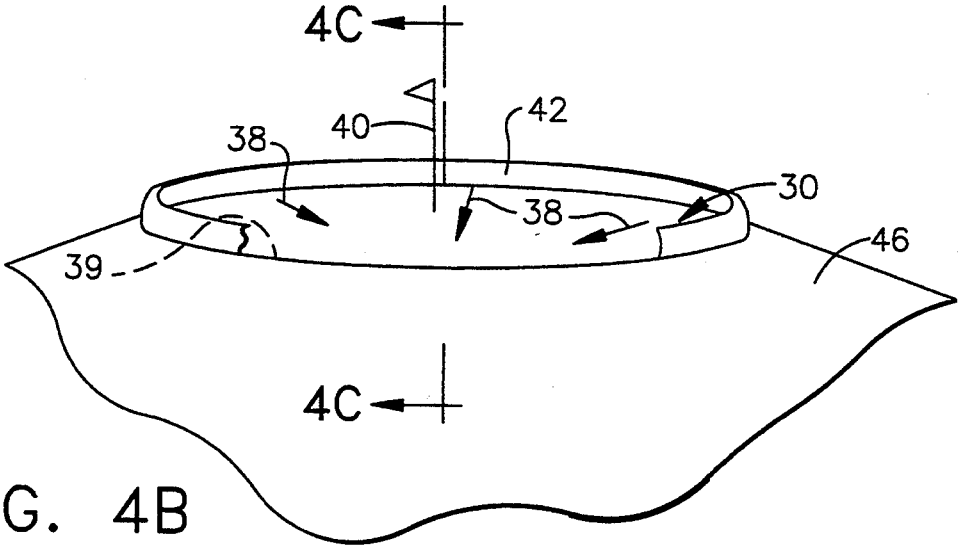
FIG. 4B is an elevational view of the target green as viewed from the bottom of FIG. 4A.
Figure 4C:
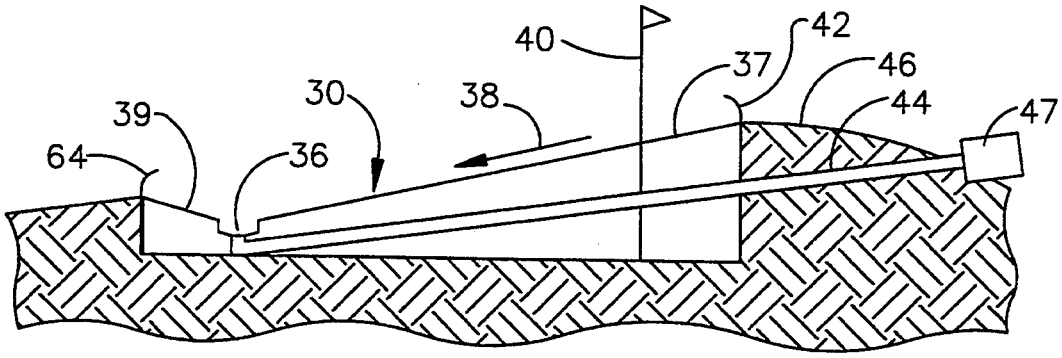
FIG. 4C is a cross-sectional view of the target green of FIG. 4B, taken along section line 4C—4C.

Target green 30 would appear to the golfer at the teeing area 20 to have a sudden drop off near the front portion of the green, and then a gradual slope upwardly toward the back of the green, as is generally depicted in FIG. 4B. FIG. 4C also depicts the same downward slope near the front of the green (designated by the numeral 39), the receptacle hole 36, and the largest portion of the green, designated by the numeral 37, which gradually slopes upwardly toward the rear of the green. The direction of the slope arrow 38 is also indicated on FIG. 4C. A ball redirector 42 is located around the perimeter of the green 30, and a ball ejector tube 44 is used to carry the balls 10 from receptacle hole 36 out of the green area 30 into a container 47 at the graded rear portion 46 of the green. The balls 10 can later be easily collected from container 47 for re-use at the tees 20. As can be seen in FIG. 4C, the overall construction of the green is backgraded at the area designated by the numeral 46. The target flag 40 can be located at any position on the green 30.

Figure 5:
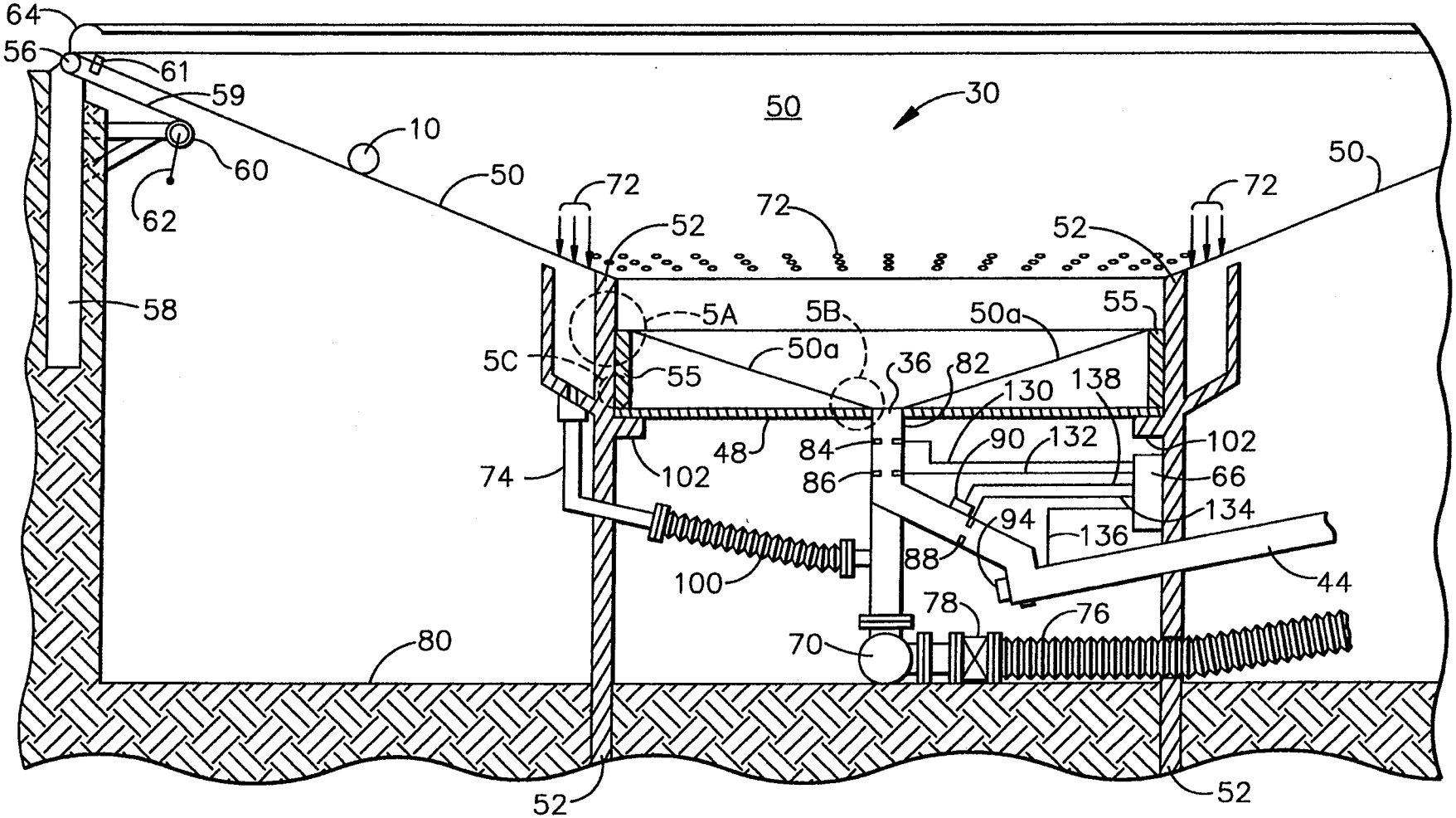
FIG. 5 is an enlarged cross-sectional elevational view of the portion of the target green of FIG. 4C which contains the receptacle hole.

As viewed in FIG. 5, a typical target green 30 includes a circular ball receptor 48 at its bottommost portion. At the center of the circular ball receptor 48 is the receptacle hole 36. The surface 50 of the green can be made from a variety of materials, however, one preferred material is manufactured by Seaman Corporation and is used to construct Portomod ®(a registered trademark of Seaman Corporation) pre-engineered tension membrane structures. This preferred material is a heavy duty, high performance polyester fabric (manufactured with Dacron ®—a registered trademark of E. I. DuPont DeNamours and Co.—polyester fibers) designed for air structures, stress membrane structures, and other applications where low elongation, high tear strength, high tensile strength, high adhesion, and long life in weather exposure are required.

A support tube 56 is located around the perimeter of the green 30. Support tube 56 is supported by a set of support columns 58 which are spaced about eight (8) feet apart around the perimeter of the green 30, each support column 58 having a ratchet drum or spool 60 attached thereto. The tension membrane material of surface 50 terminates very near support tube 56. It is preferred that the tension membrane material of surface 50 actually cover a portion of support tube 56 so that rain and snow are largely prevented from entering the area beneath surface 50 around the perimeter of the green 30 (i.e., at any gap that may otherwise exist between support tube 56 and the tension membrane material of surface 50).

A plurality of canvas straps 59 are attached to the tension membrane material 50 by use of a nut and bolt combination 61 which extends through an eyelet in both tension membrane material 50 and each canvas strap 59. Each canvas strap 59 is wrapped around this support tube 56, and further continues to one of the ratchet spools 60. Ratchet spools 60 are used to maintain tension in the tension membrane material 50, which can be tightened by use of the ratchet handle 62 associated with each spool.

The tension membrane material of surface 50 has sufficient compliance to absorb the impact of a golf ball 10 such that ball 10 will not bounce away from the target green 30. This allows a person playing the game to have a higher score by "trapping" balls which otherwise would bounce off the green. Once a golf ball 10 lands on the green surface material 50, the ball will tend to roll downhill toward the circular ball receptor 48, and ultimately into the receptacle hole 36. As related above, a ball redirector 42 can be located on support tube 56, around the back portions of the perimeter of the green 30 (see FIG. 4C), and a similar ball redirector 64 can be located around the front portions of the green 30 (see FIG. 5 ).

Figure 5A:
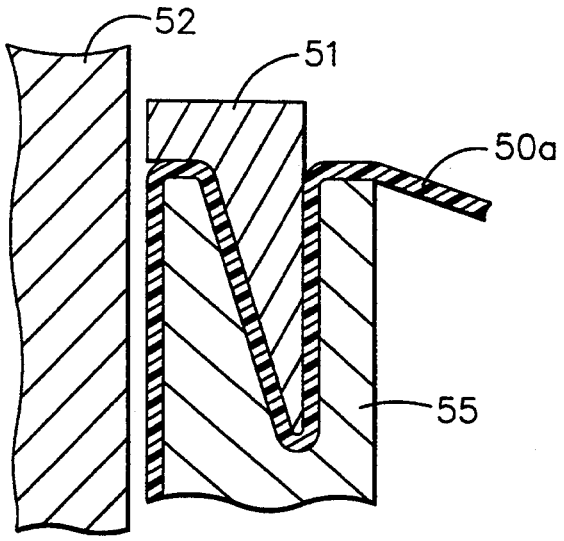
FIG. 5A is a magnified cross-sectional elevational view of the top portion of the circular ball receptacle.
Figure 5B:
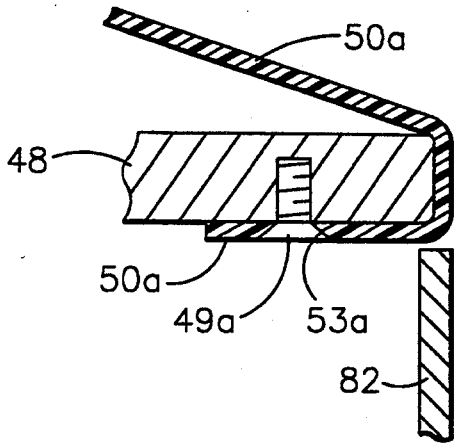
FIG. 5B is a magnified cross sectional elevational view of the bottom-center portion of the circular ball receptacle.
Figure 5C:
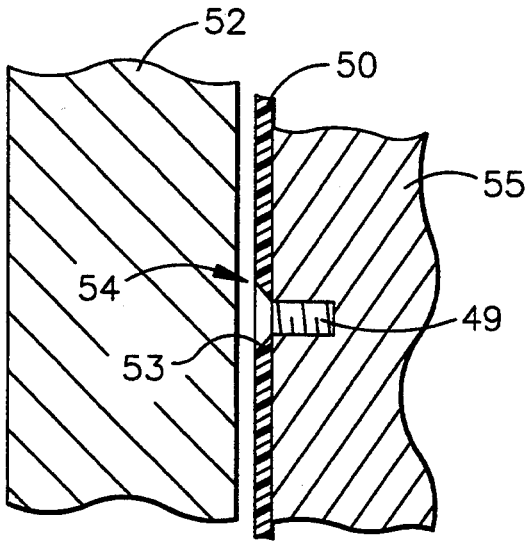
FIG. 5C is a magnified cross-sectional elevational view of the attachment of the tension membrane material into the receptor housing.

The inner portions of the tension membrane material of surface 50 are attached to a receptor housing 52 at a plurality of locations 54 (see FIG. 5C). A countersunk hole in receptor housing 52 is provided at each location 54, and a screw 49 (having a countersunk head) extends through a corresponding eyelet 53 in surface 50 and into each countersunk hole. This arrangement provides for a smooth vertical surface at locations 54, so that the circular ball receptor 48 may be easily installed into and removed from its location within the inner perimeter of receptor housing 52. A set of shoulder supports 102, on which the circular ball receptor 48 rests, are affixed to receptor housing 52. Shoulder supports 102 could consist of an annular rim. A control module 66, which is the electronic "brain" of the sensing devices located within the target green 30, is also attached to the receptor housing 52.

Ball receptor 48 is preferably circular in peripheral configuration and includes a vertical wall 55 which has an outer diameter slightly less than the inner diameter of receptor housing 52. The sloped upper surface **50*a* of ball receptor 48 is preferably made of the same tension membrane material which is used in surface 50, manufactured by Seaman Corporation for use in constructing Portomod® pre-engineered tension membrane structures. Upper surface material 50*a* is attached near the center of ball receptor 48 to the bottom-side of ball receptor 48 (see FIG. 5B). Several countersunk holes in the bottom of ball receptor 48 each receive a screw 49*a* (having a countersunk head) which also extends through a corresponding eyelet 53*a* in upper surface material 50*a***.

The outer edge portions of upper surface material **50*a* are attached to vertical wall 55 by use of a wedge and slot arrangement at the top of vertical wall 55. As best viewed in FIG. 5A, the top of vertical wall 55 has a slot into which the outer edge of upper surface material 50*a* is placed and glued. A circular wedge 51 is pressed down into the slot, thereby producing a tension in the tension membrane material of upper surface 50*a*, at which time the wedge 51 itself is glued into place. This arrangement produces a sloped surface 50*a* which is permanently under tension, yet which has sufficient compliance to absorb the impact of a golf ball 10 such that ball 10 will not bounce away from the target green 30**.

A sump pump 70 is used to carry away any water that flows down through receptacle hole 36. Sump pump 70 can also be used to carry away water which accumulates through perforated areas, designated by the numeral 72, in the tension membrane material 50, which are located near the perimeter area around the receptor housing 52. A preferred arrangement for perforated areas 72 is to place a small hole every ¼-inch in tension membrane material 50 within the desired perimeter area around receptor housing 52. Water draining through such perforated areas 72 would tend to drain down through a drain tube 74, further into a drain hose 100, and finally arriving at sump pump 70. The sump pump would force water through a discharge hose 76 after passing through a check valve 78.

The entire target green area 30 is built upon a grade line 80 from which the receptor housing 52 is mounted. All of the various equipment and green playing areas are located at an elevation above the grade line 80.

Once a ball 10 enters the receptacle hole 36, it passes through a ball receiving tube 82 and arrives at upper indexer pins 84. If no previous ball has arrived, the new ball will be passed from the upper indexer pins 84 to a set of lower indexer pins 86.

Figure 6:
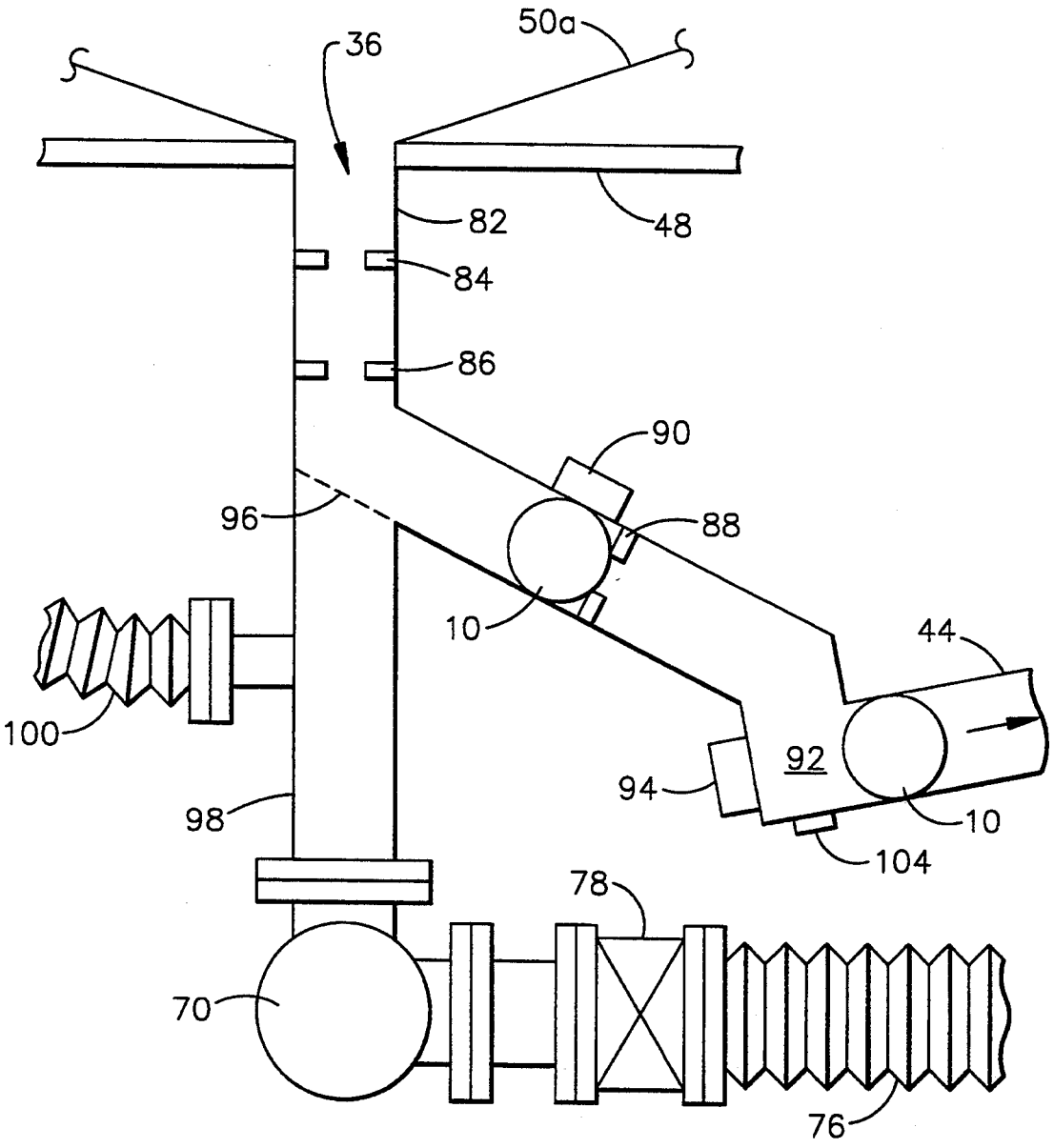
FIG. 6 is a fragmentary enlarged cross-sectional elevational view of the target green mechanism of FIG. 5, showing the details around the receptacle hole.

These indexer pins can be viewed in both FIGS. 5 and 6. When the lower indexer pins 86 sense a ball 10, the upper indexer pins 84 close, thereby isolating the ball resting on the lower indexer pins 86. Once the upper indexer pins 84 are completely closed, the lower indexer pins 86 open and the ball falls via gravity past a water screen 96 and comes to rest at a final set of indexer pins 88. Once the ball comes to rest at this final set of indexer pins 88 (as depicted in FIG. 6), the sensor 90 can then read the surface of ball 10 in order to determine from which teeing area 20 ball 10 was driven. Sensor 90 is either a color sensor, if colored balls are being used, or is a bar code reader if balls having a stamped bar code are being used.

Once the correct teeing area 20 of the ball 10 has been determined by the sensor 90, final indexer pins 88 open and allows the ball to fall to a location designated by the numeral 92. If sensor 90 cannot properly read ball 10, it will repeatedly attempt to read that ball's code for a predetermined number of attempts, and, if unsuccessful, it will finally determine that the ball is unreadable and will allow ball 10 to pass through the final indexer pins 88 regardless. In addition, if a neutral (white) is being played, the sensor 90 will determine that fact and will allow the ball 10 to pass through the final indexer pins 88 without attempting any further reads of that ball.

If water passes through the receptacle hole 36, it will drain down through water screen 96, through the pump suction tube 98, and finally into the sump pump 70. At that point the water can be disposed of at the discharge of the sump pump 70, being pumped through check valve 78 and discharge hose 76.

Once the ball 10 arrives at the location designated by the numeral 92, a ball ejector mechanism 94 propels the ball upward along the ball ejector tube 44. Ball ejector mechanism 94 impacts upon the ball 10 with enough force to overcome gravity and friction such that the ball will pass completely through the ball ejector tube 44 and out to ball collecting container 47 at the graded rear portion 46.

As can be seen best in FIG. 6, water can enter the pump suction tube 98 from either drain hose 100 or through receptacle hole 36 after passing through water screen 96. A level switch (not shown) can activate sump pump 70 which will then pump the water out through check-valve 78 and discharge hose 76. Some of the water may also pass through the tube that contains sensor 90 and the final indexer pins 88. This water should be a minimal amount, however, it can be drained through a drain connection 104 if necessary.

Figure 7:
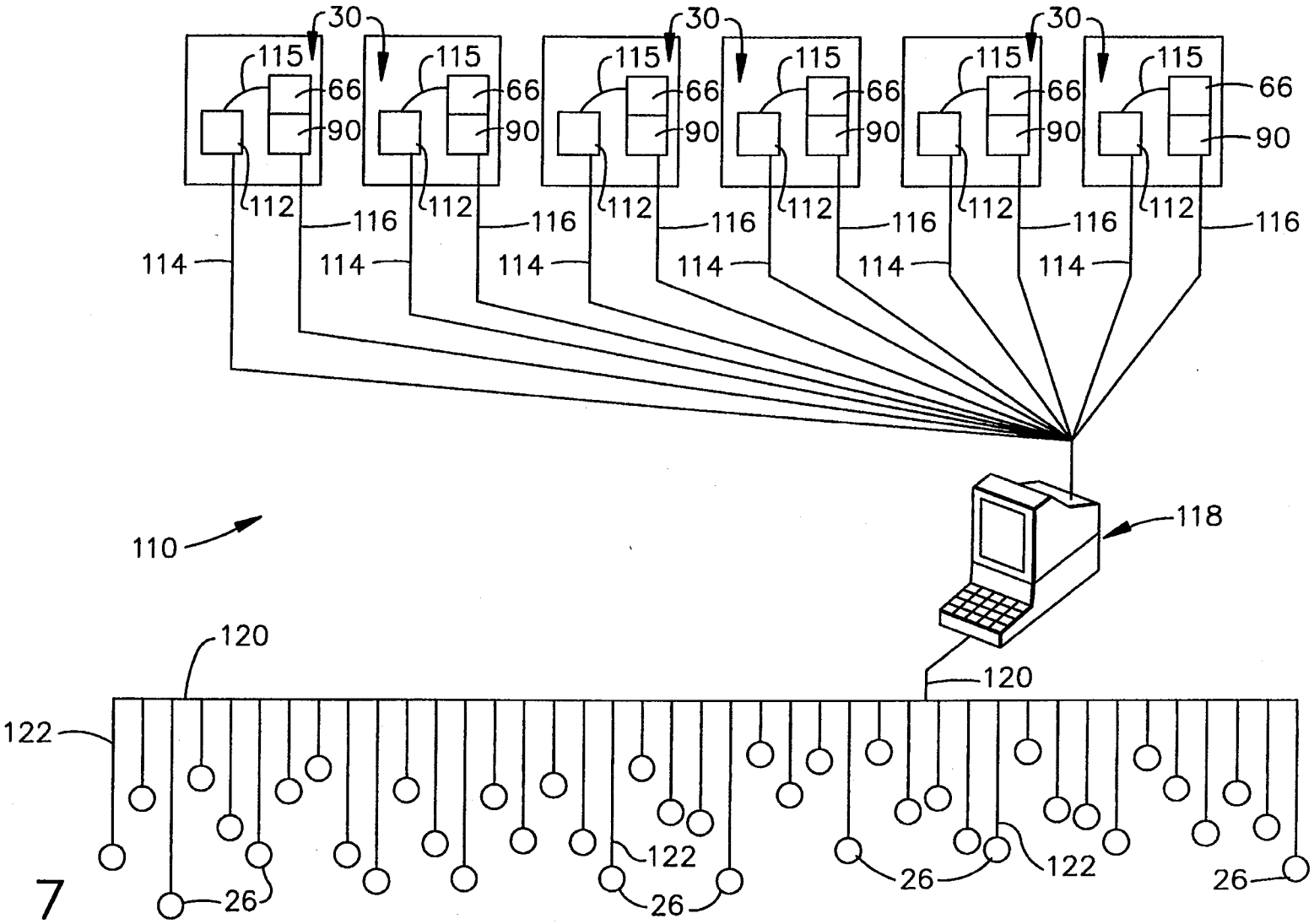
FIG. 7 is a diagrammatic view of the overall scoring system used in conjunction with the driving range game of FIG. 3.

FIG. 7 is a diagram of the overall data collection system 110. In the illustrated embodiment of FIG. 7, data collection system 110 has six target greens 30, a large number of displays 26 which act as scoring indicators at each of the driving tees 24, and a single system controller 118. The system controller 118 is preferably a personal computer having expansion slots which allow system controller 118 to use plug-in data acquisition printed circuit boards. Such plug-in data acquisition printed circuit boards may comprise communications input/output cards which allow system controller 118 to receive signals from each of the sensors 90, and which may also allow system controller 118 to transmit signals to each of the displays 26. The signal format may be adapted to various communications protocols, however, a preferred protocol is the industry standard IAI RS-422.

Each of the target greens 30 includes an electrical power supply 112 which has associated power wiring 114 that connects back to the system controller 118. Each of the target greens 30 also includes a set of electronics which includes the control module 66 and the sensor 90. The output of sensor 90 is communicated through signal wiring 116 to the system controller 118.

Within each target green 30 are several different wires, including power wiring 115 which connects power supply 112 with the control module 66. Control module 66 communicates with several other devices, thereby either controlling the other devices or accepting sensor inputs from them. For example, control module 66 controls the action of the upper indexer pins 84 via control wiring 130 (see FIG. 5). Control module 66 controls the action of lower indexer pins 86 via control wiring 132. Control module 66 controls the action of the final indexer pins 88 via control wiring 134. Control module 66 also controls the ball ejector mechanism 94 via control wiring 136. The output of the sensor 90 is communicated to control module 66 via signal wiring 138.

System controller 118 communicates with each of the displays 26 through a system of data wiring 120. The system of data wiring 120 further communicates the proper signals to each of the displays 26 by individual display signal wiring 122. The system of data wiring 120 can either be a trunk line of parallel cables, each containing the proper signals for a single display 26, or it can be a multiplexed data cable, using a multiplexer at the system controller 118 and a demultiplexer at each of the displays 26.

Figure 8:
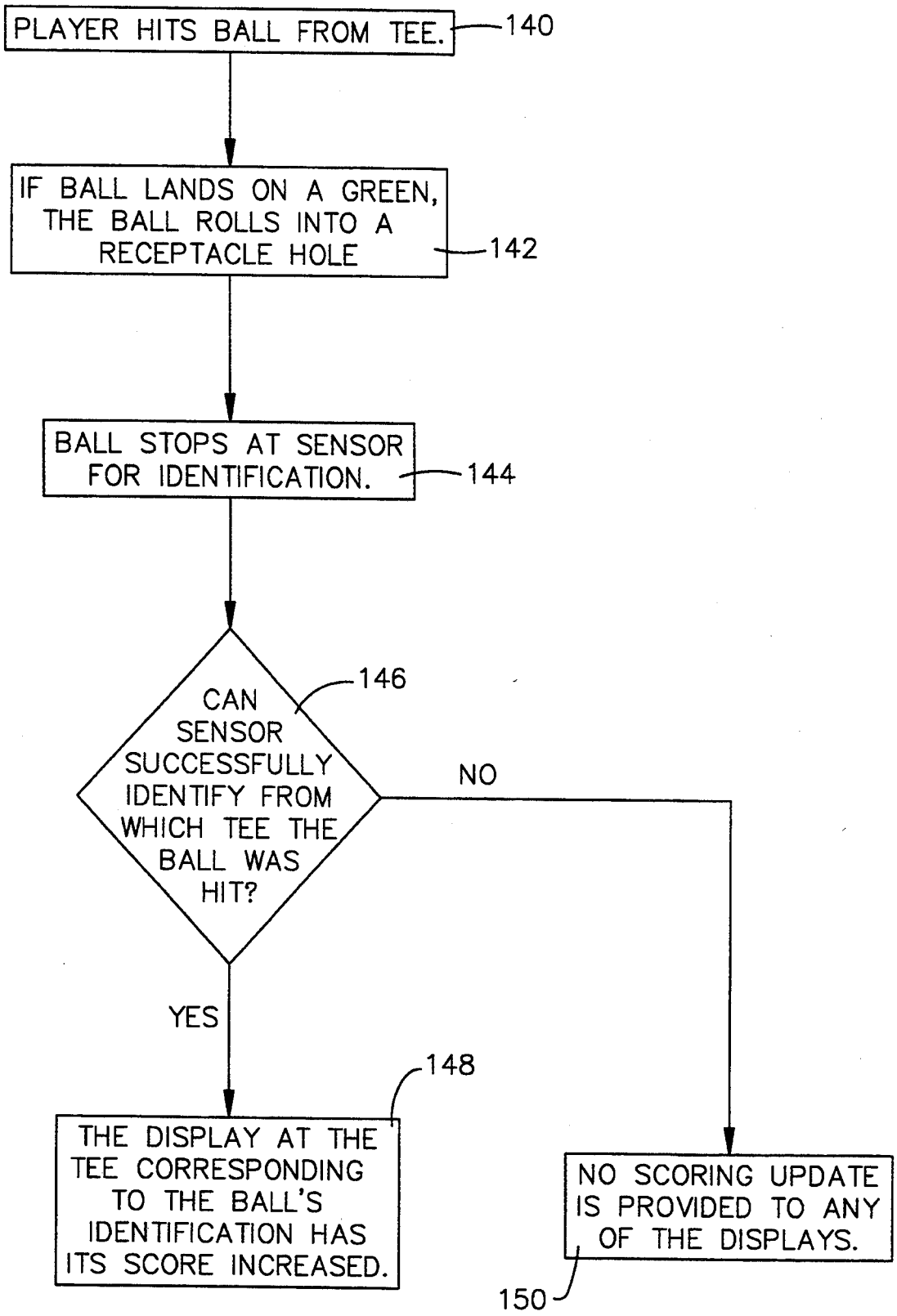
FIG. 8 is flow chart showing the steps taken to play the golfing range game in accordance with the principles of the present invention.

FIG. 8 is a flow chart giving the major steps required to implement the golfing game according the principles of the present invention. In the first step, designated by the numeral 140, the player hits a golf ball 10 from one of the driving tees 24. The ball 10 will, obviously, either land upon a target green 30 or completely miss all of the available target greens. If the ball 10 lands upon one of the target greens 30, the next step of this method is performed designated by the numeral 142, in which the ball 10 rolls into a receptacle hole 36.

The ball 10 must next be identified in step 144. The ball 10 is held in place at sensor 90 long enough for the ball to be identified by sensor 90. The attempt to successfully identify the ball occurs in step 146. If sensor 90 successfully identifies the ball, then the final step, designated by the numeral 148, increases the score at the display 26 located at the tee 24 which corresponds to the identification markings upon the ball 10.

On the other hand, if the ball 10 cannot be successfully identified at method step 146, then the final step, designated by the numeral 150, is performed wherein no scoring update is provided to any of the display 26. If a plain white ball lands upon a target green 30, then final step 150 occurs, in which no score is indexed at any of the displays 26.

The method steps of FIG. 8 are performed every time any ball is hit from any tee of the golfing game. The system controller 118 processes all of the data signals received over signal wiring 116 from each of the target greens 30. More than one updating signal may be received simultaneously at system controller 118, however, by use of standard data acquisition techniques, system controller 118 can process each of these signals sequentially as per its internal computer program, Such data collecting techniques are presently available using standard components which can be purchased and used with standard personal computers.

The controlling of the individual displays 26 is performed by system controller 118. The timing and updating of each of the displays 26 is controlled by system controller 118, using standard communications input/output cards which can be purchased for use with many available personal computers. The number of individual displays 26 which can be controlled by system controller 118 is virtually limitless, since extra communications input/output cards can be provided for each grouping of displays 26. (For example, each communications input/output card may be able to communicate data to sixteen (16) of the displays 26.) Again, such communications input/output cards are standard hardware which are available at the present time.

The target greens 30 can be installed at any existing driving range. A small area of land would need to be dug out and graded, along grade line 80, for each green. The excess dirt is used to back-grade the rear portion of each green 30 at the locations designated by the numeral 46. A set of cables 114 and 116 is run underground from each green 30 to the system controller 118, which could be located in the clubhouse 34.

Each of the teeing areas 20 requires a scoring display 26 and a data cable 122 to be added to the tees of an existing driving range. Cables 122 are also run underground to a multiplexed or trunk cable 120, which, in turn, runs to system controller 118.

The golfing game of the present invention is, thus, easily retrofitted into an existing driving range with minimal difficulty. The only significant "down time" of the existing driving range is to accomplish the digging out of the greens and cable runs.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A method for playing a point-scoring game at a golfing range comprising the steps of:

(a) providing a plurality of golfing tees, each of which has an associated scoring device and a plurality of golf balls:

(b) providing each golf ball with an identifying characteristic which makes it possible to determine from which tee the golf ball originated;

(c) striking one of said golf balls at one of the plurality of golfing tees;

(d) providing a plurality of target greens which are remotely located from the plurality of golfing tees, each target green having a front portion and a rear portion, providing each target green with a receptacle hole and sloping the surface of each target green in a manner to cause said golf ball, once it lands upon the target green, to roll into said receptacle hole, said sloped surface forming an asymmetrical concave shape, said sloped surface having said receptacle hole located at its lowest point, said sloped surface having a profile, as viewed from the side of said target green, which is greatest in elevation at its rearmost end located at the rear portion of the target green furthest from said golfing tees, said profile continuously sloping downward, toward the front portion of the target green nearest to said golfing tees, until arriving at said receptacle hole, said downward slope travelling substantially more than one-half the distance between the front and rear portions of the target green, said profile, as it continues forward from said receptacle hole, continuously sloping upward toward the front portion of the target green, said profile's forwardmost end located at the forward portion of the target green having an elevation that is significantly lower than that at its rearmost end, said upward slope travelling substantially less than one-half the distance between the front and rear portions of the target green;

(e) sensing said identifying characteristic of the golf ball, and identifying from which of said plurality of golfing tees the golf ball originated; and (f) indexing the score of the scoring device which is located at the golfing tee corresponding to the identifying characteristic of said golf ball.

2. A method for playing a point-scoring game at a golfing range as recited in claim 1, wherein the identifying characteristic of each of said golf balls is a distinctive color which is applied to the surface of the golf ball.

3. A method for playing a point-scoring game at a golfing range as recited in claim 1, wherein the identifying characteristic of each of said golf balls is a distinctive bar code which is applied to the surface of the golf ball.

4. A method for playing a point-scoring game at a golfing range as recited in claim 2, wherein the step of sensing said identifying characteristic of the golf ball comprises a color detecting apparatus.

5. A method for playing a point-scoring game at a golfing range as recited in claim 3, wherein the step of sensing said identifying characteristic of the golf ball comprises reading with a bar code reader.

6. A method for playing a point-scoring game at a golfing range as recited in claim 1, wherein the step of indexing the score of said scoring device provides a different score value for each of said target greens.

7. An apparatus used for playing a point-scoring game at a golfing range, comprising:

(a) a plurality of golfing tees, each including:

(i) a planar area which is large enough to safely swing a golf club;

(ii) a scoring display which provides an indication of a player's score;

(iii) a plurality of golf balls for each tee, each of said balls for a particular tee having a distinctive identifying marking;

(b) a plurality of target greens which are remotely located from the plurality of golfing tees, each target green having a front portion and a rear portion, each said target green including:

(i) a receptacle hole that is large enough for a golf ball to easily fit through:

(ii) a sloped surface forming an asymmetrical concave shape, said sloped surface having said receptacle hole located at its lowest point, said sloped surface having a profile, as viewed from the side of said target green, which is greatest in elevation at its rearmost end located at the rear portion of the target green furthest from said golfing tees, said profile continuously sloping downward, toward the front portion of the target green nearest to said golf tees, until arriving at said receptacle hole, said downward slope travelling substantially more than one-half the distance between the front and rear portions of the target green, said profile, as it continues forward from said receptacle hole, continuously sloping upward toward the front portion of the target green, said profile's forwardmost end located at the forward portion of the target green having an elevation that is significantly lower than that at its rearmost end, said upward slope travelling substantially less than one-half the distance between the front and rear portions of the target green;

(iii) a sensor that detects the distinctive identifying marking on said golf ball, and produces a corresponding first signal;

(iv) a control module to receive said first signal from said sensing means, and to produce a corresponding second signal;

(c) a system controller, including:

(i) a communications input device which receives input data in the form of said second signal from said control module, said input data being indicative of a particular target green and a particular distinctive identifying marking which appeared upon a golf ball; and (ii) a communications output device which transmits output data in the form of a third signal to said scoring display of said tee corresponding to said ball identifying marking, said output data being indicative of a player's score.

8. An apparatus used for playing a point-scoring game at a golfing range as recited in claim 7, wherein said display indicates a numerical score which is easily visible to the player who is located at that respective golfing tee.

9. An apparatus used for playing a point-scoring game at a golfing range as recited in claim 7, wherein the distinctive identifying marking upon each of said plurality of golf balls comprises a distinctive color which is applied to the surface of the golf ball.

10. An apparatus used for playing a point-scoring game at a golfing range as recited in claim 7, wherein the distinctive identifying marking upon each of said plurality of golf balls comprises a distinctive bar code which is applied to the surface of the golf ball.

11. An apparatus used for playing a point-scoring game at a golfing range as recited in claim 7, wherein the concave shape of each target green is configured so that any golf ball striking the target green will easily roll into said receptacle hole located at the lowest point of the surface of that target green.

12. An apparatus used for playing a point-scoring game at a golfing range as recited in claim 7, wherein said sensor that detects the distinctive identifying marking on the golf ball comprises a color detecting apparatus.

13. An apparatus used for playing a point-scoring game at a golfing range as recited in claim 7, wherein said sensor that detects the distinctive identifying marking on the golf ball comprises a bar code reader.

14. An apparatus used for playing a point-scoring game at a golfing range as recited in claim 7, wherein said system controller comprises:

(i) a personal computer having means for processing digital data, a memory system, and input/output ports which read input data and write output data;

(ii) input/output hardware which receives said second signal from said control module located at a plurality of target greens, and which thereafter converts said second signal into input data;

(iii) means for determining the scoring values, as said input data indicates target greens which have received a ball from said golfing tees, for each of said golfing tees;

(iv) means for temporarily storing said input data into said memory system, thereby retaining past and updating current scoring values for each golfing tee;

(v) means for writing as output data, from said memory system, the scores for each of said plurality of golfing tees to said input/output hardware; and (vi) input/output hardware which converts said output data into said third signal, and thereafter transmits that third signal to said scoring display located at a plurality of golfing tees.

* * * * *